US010784018B2

(12) United States Patent
Kaga et al.

(10) Patent No.: US 10,784,018 B2
(45) Date of Patent: Sep. 22, 2020

(54) INSULATED WIRE

(71) Applicant: Hitachi Metals, Ltd., Minato-ku, Tokyo (JP)

(72) Inventors: Masafumi Kaga, Tokyo (JP); Tamotsu Kibe, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/175,127

(22) Filed: Oct. 30, 2018

(65) Prior Publication Data

US 2019/0139678 A1 May 9, 2019

(30) Foreign Application Priority Data

Nov. 7, 2017 (JP) ..... 2017-214559

(51) Int. Cl.

| | |
|---|---|
| ***H01B 7/295*** | (2006.01) |
| ***H01B 7/02*** | (2006.01) |
| ***H01B 3/44*** | (2006.01) |
| ***H01B 3/30*** | (2006.01) |

(52) U.S. Cl.

CPC ..... *H01B 7/295* (2013.01); *H01B 3/441* (2013.01); *H01B 3/447* (2013.01); *H01B 7/0225* (2013.01); *H01B 7/0291* (2013.01); *H01B 3/307* (2013.01); *H01B 3/448* (2013.01)

(58) Field of Classification Search

CPC .... H01B 7/295; H01B 7/0225; H01B 7/0291; H01B 3/307; H01B 3/448

See application file for complete search history.

(56) References Cited

U.S. PATENT DOCUMENTS 4,187,389 A * 2/1980 Foote ..... H02G 15/068 156/53
4,549,041 A * 10/1985 Shingo ..... C08K 3/22 174/113 R
4,554,173 A * 11/1985 Fujimura ..... H01B 3/441 264/171.15

(Continued)

FOREIGN PATENT DOCUMENTS

JP 5-47225 A 2/1993
JP 6-52728 A 2/1994

(Continued)

OTHER PUBLICATIONS

U.S. Appl. No. 16/175,019, filed Oct. 30, 2018.

(Continued)

*Primary Examiner* — William H. Mayo, III
*Assistant Examiner* — Rhadames Alonzo Miller
(74) *Attorney, Agent, or Firm* — Crowell & Moring LLP

(57) ABSTRACT

An insulated wire having an electrical wire structure capable of reducing an outer diameter while an insulating property and a flame-retardant property are highly kept is provided. In the insulated wire including: a conductor; and a coating layer arranged on an outer periphery of the conductor, the insulated wire has a flame-retardant property that allows the insulated wire to pass a vertical tray flame test (VTFT) on the basis of EN 50266-2-4, has a direct-current stability that allows the insulated wire to pass a direct-current stability test in conformity to EN 50305.6.7, has a diameter of the conductor that is equal to or smaller than 1.25 mm, and has a thickness of the coating layer that is smaller than 0.6 mm.

16 Claims, 3 Drawing Sheets

(56) References Cited

U.S. PATENT DOCUMENTS 4,769,179 A * 9/1988 Kato ..... C08K 3/22 252/601
5,001,304 A * 3/1991 Hardin ..... G02B 6/443 174/107
5,358,786 A * 10/1994 Ishikawa ..... H01B 3/30 174/110 AR
6,034,162 A * 3/2000 Mizutani ..... C08K 5/09 428/921
6,359,230 B1 * 3/2002 Hildreth ..... H01B 3/441 174/110 R
6,755,995 B1 * 6/2004 Hasegawa ..... C08K 3/22 106/18.11
8,946,557 B2 * 2/2015 Fukuda ..... H01B 3/301 174/110 AR
9,443,645 B2 9/2016 Iwasaki et al.
9,514,860 B2 * 12/2016 Kikuchi ..... H01B 7/295
2001/0009198 A1 * 7/2001 Belli ..... H01B 3/441 174/110 R
2003/0141097 A1 * 7/2003 Belli ..... H01B 3/441 174/110 R
2003/0164483 A1 * 9/2003 Scelza ..... C08K 3/34 252/601
2004/0149483 A1 * 8/2004 Glew ..... G02B 6/4435 174/113 C
2005/0045368 A1 * 3/2005 Keogh ..... H01B 3/446 174/120 R
2006/0096777 A1 * 5/2006 Glew ..... H01B 11/04 174/113 C
2007/0010615 A1 * 1/2007 Cogen ..... C08L 23/0815 524/515
2008/0311328 A1 * 12/2008 Kimura ..... C08K 9/06 428/36.91
2008/0317990 A1 12/2008 Runyan et al.
2009/0200059 A1 * 8/2009 Cinquemani ..... H01B 9/025 174/113 R
2010/0163269 A1 * 7/2010 Perego ..... H01B 3/441 174/107
2011/0111153 A1 5/2011 Russell et al.
2011/0172367 A1 7/2011 Backer et al.
2011/0198105 A1 * 8/2011 Shanai ..... H01B 7/295 174/110 SR
2012/0227997 A1 * 9/2012 Koelblin ..... H01B 1/24 174/102 SC
2013/0092416 A1 * 4/2013 Saito ..... H01B 3/28 174/120 SC
2013/0228358 A1 * 9/2013 Fujimoto ..... H01B 7/292 174/110 SR
2014/0011028 A1 1/2014 Iwasaki et al.
2014/0030520 A1 * 1/2014 Nakamura ..... H01B 3/308 428/368
2014/0083738 A1 * 3/2014 Segawa ..... H01B 7/295
2014/0166339 A1 * 6/2014 Bates ..... H01B 7/295 174/120 R
2014/0182883 A1 * 7/2014 Sugita ..... H01B 3/447 174/113 R
2014/0370315 A1 * 12/2014 Iwasaki ..... H01B 3/441 428/516
2015/0034359 A1 * 2/2015 Sugita ..... H01B 7/295 174/107
2015/0371735 A1 * 12/2015 Iwasaki ..... H01B 7/29 428/372
2016/0049221 A1 * 2/2016 Lee ..... H01B 3/441 174/107
2016/0125973 A1 * 5/2016 Iwasaki ..... H01B 3/448 428/383
2016/0148724 A1 * 5/2016 Kikuchi ..... H01B 7/295 174/107
2017/0032867 A1 2/2017 Iwasaki et al.
2017/0365373 A1 * 12/2017 Hirano ..... H01B 3/10
2017/0365378 A1 * 12/2017 Kaga ..... C08L 23/0853
2018/0033522 A1 * 2/2018 Blair ..... H01B 13/08

FOREIGN PATENT DOCUMENTS

JP 2001-347559 A 12/2001
JP 2007-168500 A 7/2007
JP 2011-228189 11/2011
JP 2014-11140 A 1/2014
JP 2014-225478 12/2014
JP 2015-74730 A 4/2015
JP 2015-118857 A 6/2015
JP 2017-27878 A 2/2017
KR 10-0855795 B1 9/2008

OTHER PUBLICATIONS

U.S. Appl. No. 16/174,996, filed Oct. 30, 2018.
Non-Final US Office Action issued in U.S. Appl. No. 16/174,996 dated Mar. 28, 2019 (14 pages).
"Common Test Methods for Cables Under Fire Conditions-Test for Vertical Flame Spread of Vertically-Mounted Bunched Wires or Cables", British Standard, EN 50266-2-4:2001 (14 pages).
"Railway Applications—Railway Rolling Stock Cables Having Special Fire Performance-Test Methods", British Standard, EN 50305:2002 (42 pages).
"Testing Methods of Plastic Films for Electrical Purposes" JIS C2151, Aug. 20, 2006, Japanese Standards Association, with partial English translation (57 pages).
"Plastics—Determination of Burning Behavior by Oxygen Index—Part 2: Ambient-Temperature Test", JIS K7201-2, Mar. 20, 2007, Japanese Standards Association, with partial English translation (40 pages).
Japanese-language Office Action issued in counterpart Japanese Application No. 2017-214559 dated Feb. 5, 2019 with English translation (seven (7) pages).
Japanese-language Office Action issued in counterpart Japanese Application No. 2017-214558 dated Feb. 5, 2019 with English translation (seven (7) pages).
Japanese-language Office Action issued in counterpart Japanese Application No. 2017-214346 dated Feb. 1, 2019 with English translation (six (6) pages).
Final U.S. Office Action issued in U.S. Appl. No. 16/174,996 dated Oct. 3, 2019 (10 pages).
Non-final US Office Action issued in U.S. Appl. No. 16/175,019 dated May 16, 2019 (16 pages).
Non-Final US Office Action issued in U.S. Appl. No. 16/174,996 dated Feb. 24, 2020 (13 pages).
Final U.S. Office Action issued in U.S. Appl. No. 16/175,019 dated Nov. 27, 2019 (11 pages).
Japanese-language Office Action issued in Japanese Application No. 2017-214558 dated Mar. 26, 2020 with English translation (12 pages).
Japanese-language Office Action issued in Japanese Application No. 2017-214346 dated Mar. 26, 2020 with English translation (nine (9) pages).
Japanese-language Office Action issued in Japanese Application No. 2017-214559 dated Mar. 26, 2020 with English translation (12 pages).
U.S. Non-Final Office Action issued in U.S. Appl. No. 16/175,019 dated Mar. 18, 2020 (13 pages).
Japanese-language Office Action issued in counterpart Japanese Application No. 2017-214558 dated Nov. 20, 2018 (four (4) pages).
Japanese-language Office Action issued in counterpart Japanese Application No. 2017-214346 dated Nov. 22, 2018 (three (3) pages).
Japanese-language Office Action issued in counterpart Japanese Application No. 2017-214559 dated Nov. 20, 2018 (three (3) pages).

* cited by examiner

INSULATED WIRE

CROSS-REFERENCE TO RELATED APPLICATION

The present application claims priority from Japanese Patent Application No. 2017-214559 filed on Nov. 7, 2017, the content of which is hereby incorporated by reference into this application.

TECHNICAL FIELD OF THE INVENTION

The present invention relates to an insulated wire.

BACKGROUND OF THE INVENTION

Insulated wires, which are used as wiring in railroad cars and automobiles, are required to have not only the insulation property but also such a flame-retardant property as making the wires difficult to burn at the time of fire. For this reason, a flame retardant is contained in a coating layer of the insulated wire. For example, Japanese Patent Application Laid-Open Publication No. 2014-11140 (Patent Document 1) discloses an insulated wire having a coating layer formed by stacking a flame-retardant layer containing a flame retardant on an outer periphery of an insulating layer having an insulation property. According to the Patent Document 1, the insulation property and the flame-retardant property can be well balanced at a high level.

SUMMARY OF THE INVENTION

Meanwhile, in recent years, reducing an outer diameter of the insulated wire has been required for a purpose of reducing a weight of the insulated wire. Therefore, reducing thicknesses of an inner-positioned insulating layer and an outer-positioned flame-retardant layer has been studied.

Accordingly, an object of the present invention is to provide an insulated wire having a wire structure in which the outer diameter of the wire can be reduced while the insulation property and the flame-retardant property are kept high.

The present invention provides the following insulated wires.

[1] The insulated wire includes: a conductor; and a coating layer arranged on an outer periphery of the conductor. The insulated wire has a flame-retardant property that allows the insulated wire to pass a vertical tray flame test (VTFT) on the basis of EN 50266-2-4 and has a direct-current stability that allows the insulated wire to pass a direct-current stability test in conformity to EN 50305.6.7, a diameter of the conductor is equal to or smaller than 1.25 mm, and a thickness of the coating layer is smaller than 0.6 mm.

[2] The insulated wire includes: a conductor; and a coating layer arranged on an outer periphery of the conductor. The insulated wire has a flame-retardant property that allows the insulated wire to pass a vertical tray flame test (VTFT) on the basis of EN 50266-2-4 and has a direct-current stability that allows the insulated wire to pass a direct-current stability test in conformity to EN 50305.6.7, a diameter of the conductor is larger than 1.25 mm and equal to or smaller than 5.0 mm, and a thickness of the coating layer is smaller than 0.7 mm.

[3] In the insulated wire described in the aspect [1] or [2], breaking elongation of the coating layer measured in a tensile test with a tension rate of 200 m/min is equal to or larger than 150%.

[4] In the insulated wire described in the aspect [1] or [2], the coating layer includes a plurality of flame-retardant layers, and an insulating layer exists between the plurality of flame-retardant layers.

[5] In the insulated wire described in the aspect [4], the flame-retardant layer has an oxygen index defined by JIS K7201-2 that is larger than 45.

[6] In the insulated wire described in the aspect [4] or [5], a volume resistivity of the insulating layer defined by JIS C2151 is larger than 5.0×10 (Ωcm).

[7] In the insulated wire described in any one of aspects [4] to [6], a flame-retardant resin composition making up the flame-retardant layer includes at least one resin selected from a group consisting of high-density polyethylene, linear low-density polyethylene, low-density polyethylene, ethylene-(α-olefin) copolymer, ethylene-vinyl acetate copolymer, ethylene-acrylic acid ester copolymer, and ethylene-propylene-diene copolymer.

[8] In the insulated wire described in any one of aspects [4] to [7], a flame-retardant resin composition making up the flame-retardant layer contains a resin component and a flame retardant so that 150 or more and 250 or less parts by mass of the flame retardant per 100 parts by mass of the resin component is contained.

[9] In the insulated wire described in any one of aspects [4] to [8], the insulating layer is made of a cross-linked substance formed by cross-linking of a resin composition.

[10] In the insulated wire described in any one of aspects [4] to [9], a resin composition making up the insulating layer contains a resin component so that the resin component is made of high-density polyethylene and/or low-density polyethylene.

According to the present invention, an insulated wire having a wire structure in which the outer diameter of the wire is reduced while the insulation property and the flame-retardant property are kept can be provided.

BRIEF DESCRIPTIONS OF THE DRAWINGS

DESCRIPTIONS OF THE PREFERRED EMBODIMENTS

Figure 3:
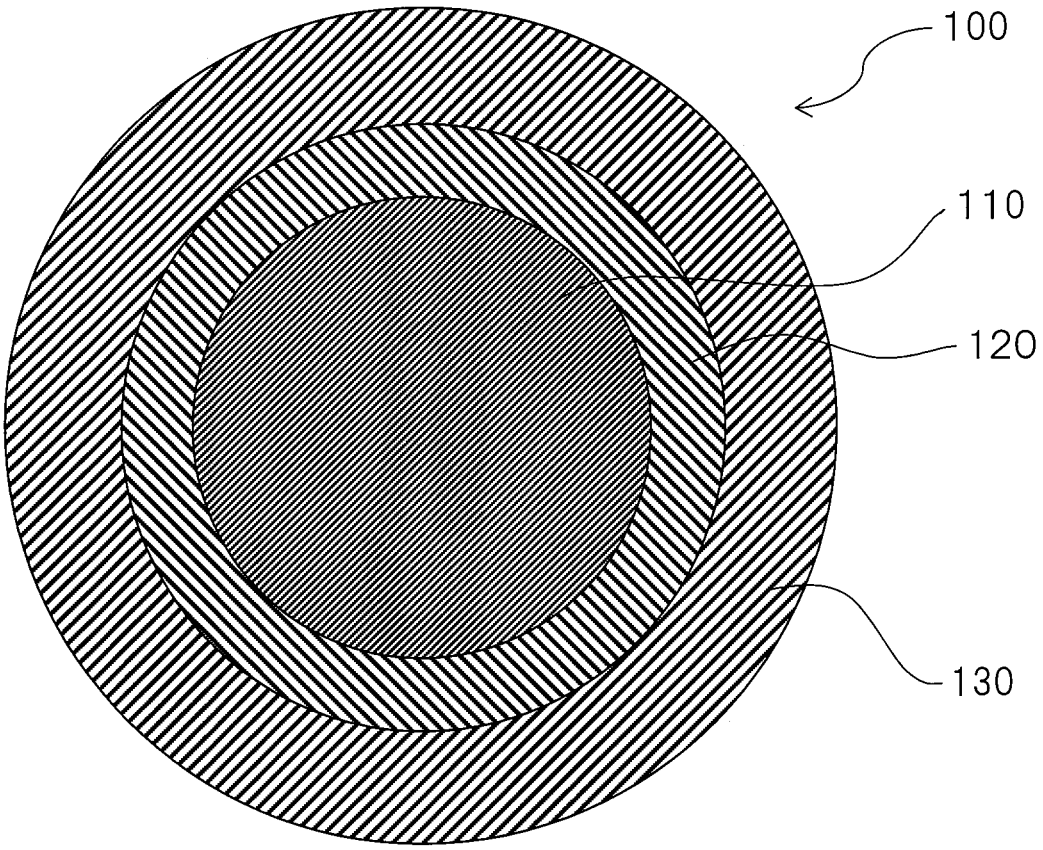
FIG. 3 is a horizontal cross-sectional view showing a related-art insulated wire.

First, the related-art insulated wire will be described with reference to FIG. 3. FIG. 3 is a cross-sectional view of the related-art insulated wire that is vertical to a longitudinal direction.

As shown in FIG. 3, a related-art insulated wire 100 includes a conductor 110, an insulating layer 120 arranged on an outer periphery of the conductor 110, and a flame-retardant layer 130 which is arranged on an outer periphery of the insulating layer 120 and mixed with a flame retardant.

In the related-art insulated wire 100, the flame-retardant layer 130 is made of a resin as similar to the insulating layer 120, and therefore, exhibits a predetermined insulation property. However, insulation reliability is low, and therefore, the insulation property does not contribute to direct-current stability in many cases. As described later, the direct-current stability is one of electrical characteristics evaluated by a direct-current stability test in conformity to the test standard EN 50305.6.7. The direct-current stability shows that a breakdown does not occur in the insulated wire even after an elapse of a predetermined time in immersion of the insulated wire 100 into salt solution with application of a predetermined voltage, and becomes an index of the insulation reliability.

According to the study made by the present inventors, it has been found out that the reason why the flame-retardant layer 130 does not contribute to the direct-current stability is that a volume resistivity is low because of the mixture of the flame retardant. As one of causes for this, in the flame-retardant layer 130, it is considered that small gaps are undesirably formed around the flame retardant because of low adherence between the resin and the flame retardant which make up the flame-retardant layer 130. Because of these gaps, moisture easily infiltrates and is absorbed into the flame-retardant layer 130. In such a flame-retardant layer 130, when the insulated wire 100 is immersed into water to evaluate its direct-current stability, a conductive path is formed because of the infiltration of the moisture to easily cause the breakdown, and therefore, there is the tendency of the low insulation reliability. In this manner, the flame-retardant layer 130 tends to have the low insulation property because of the water absorption, and consequently does not contribute to the direct-current stability.

On the other hand, the insulating layer 120 is coated with the flame-retardant layer 130, and therefore, does not need to be mixed with a flame retardant. For this reason, although the insulating layer 120 does not exhibit the flame-retardant property as observed in the flame-retardant layer 130, the insulating layer 120 is configured so as to have a high volume resistivity, and therefore, contributes to the direct-current stability.

In this manner, in the related-art insulated wire 100, the insulating layer 120 contributes to the direct-current stability while the flame-retardant layer 130 contributes to the flame-retardant property. Therefore, in order to achieve both the direct-current stability and the flame-retardant property at high levels, it is required to thicken each of the insulating layer 120 and the flame-retardant layer 130, and therefore, it is difficult to thin each of them in the purpose of reducing the diameter of the insulated wire 100.

Considering the fact that the related-art insulated wire 100 tends to absorb the moisture and has the low direct-current stability (insulation reliability) because of the formation of the flame-retardant layer 130 having the low volume resistivity on a surface, the present inventors have thought up that the flame-retardant layer 130 can contribute to not only the flame-retardant property but also the direct-current stability by configuring the flame-retardant layer 130 so that the moisture is not infiltrated therein, which consequently results in achievement of the thinning of the insulating layer 120 to allow the diameter of the insulated wire 100 to be reduced.

Accordingly, as a result of study on a method for suppressing the water infiltration into the flame-retardant layer 130, the present inventors have thought up that the insulating layer is formed on an outer periphery of the flame-retardant layer.

That is, since the water infiltration into the flame-retardant layer can be suppressed by the insulating layer, the flame-retardant layer can function as a resin layer having not only the flame-retardant property but also the direct-current stability. In this manner, the insulating layer 120 which is conventionally formed can be removed. That is, a stacked structure formed of the related-art insulating layer 120 and flame-retardant layer 130 can be formed as a stacked structure of a flame-retardant layer and an insulating layer. The insulating layer has such a thickness as preventing the water infiltration, and does not need to be thickly formed as in the related-art insulating layer 120, and therefore, the outer diameter of the insulated wire can be reduced.

However, the insulating layer practically contains no flame retardant, and therefore, is poor in the flame-retardant property. Therefore, when such an insulating layer is formed on the surface of the insulated wire, there is a risk of reduction in the flame-retardant property of the entire insulated wire.

Regarding this, the flame-retardant property is kept in the second flame-retardant layer by forming the insulating layer with the poor flame-retardant property between flame-retardant layers to form, for example, a coating layer having three layers that are a first flame-retardant layer, the insulating layer, and a second flame-retardant layer (which may hereinafter be collectively referred to as "coating layer") in this order from the conductor side, and besides, the direct-current stability is kept high by suppressing the water infiltration into the first flame-retardant layer by using the insulating layer, and the diameter can be reduced. When a plurality of such insulated wires whose diameters can be reduced are bundled together and used as a wire harness, such a further effect as a reduction in the weight of the wire harness is caused.

In addition, by forming the first and second flame-retardant layers such that they each have an oxygen index that is an index of the flame-retardant property and is higher than 45, the higher flame-retardant property of the coating layer can be kept with the first and second flame-retardant layers being further thinned.

In the present specification, note that "the diameter reduction" means that the outer diameter of the insulated wire is reduced by thinning the coating layer of the insulated wire so as to be thinner than that of the related-art insulated wire (Table 1—General data—Cable type 0.6/1 kV unsheathed of EN 50264-3-1 (2008)) having the same conductor diameter.

Specifically, when the conductor diameter is equal to or smaller than 1.25 mm, the thickness of the coasting layer of the insulated wire can be smaller than 0.60 mm. When the conductor diameter is larger than 1.25 mm and equal to or smaller than 5.00 mm, the thickness of the coasting layer of the insulated wire can be smaller than 0.70 mm.

In addition, a mechanical strength has been evaluated on the basis of the standard EN 50264, 60811-1-2, and the breaking elongation can be equal to or larger than 150%.

The present invention has been made on the basis of the above-described findings.

<Configuration of Insulated Wire>

Figure 1:
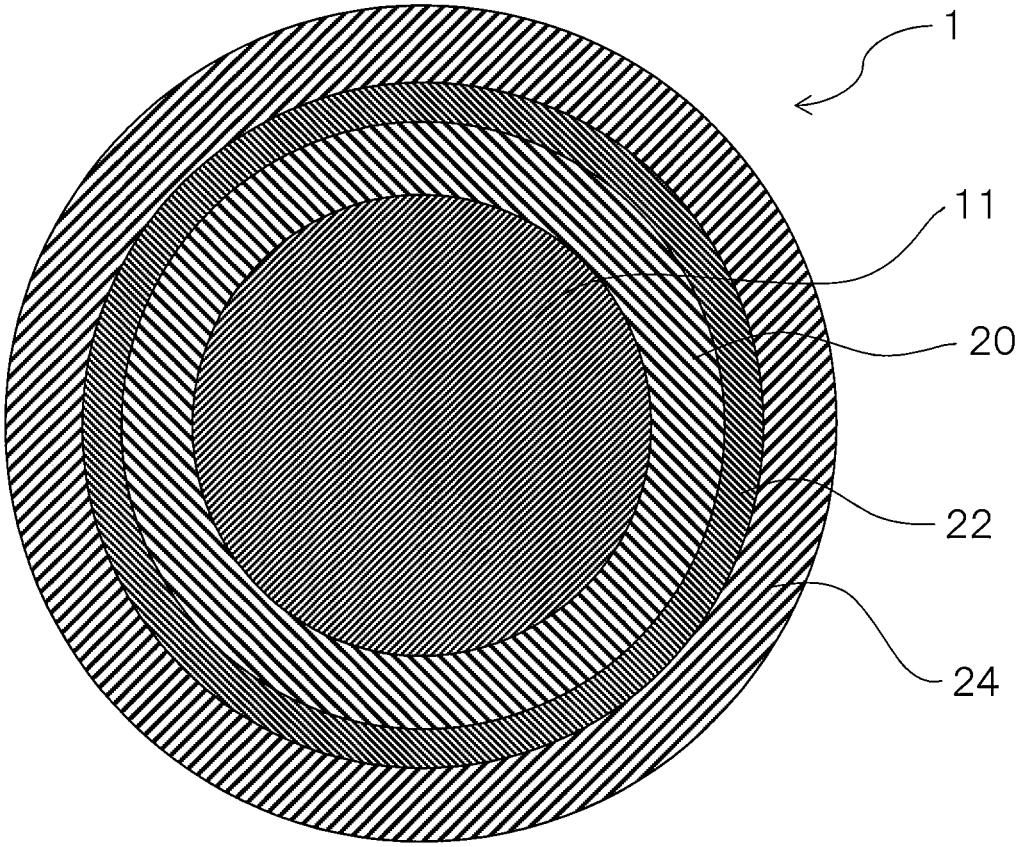
FIG. 1 is a horizontal cross-sectional view showing an embodiment of an insulated wire of the present invention.

Hereinafter, an insulated wire according to an embodiment of the present invention will be described with reference to drawings. FIG. 1 is a cross-sectional view that is vertical to a longitudinal direction of the insulated wire according to the embodiment of the present invention.

As shown in FIG. 1, the insulated wire 1 according to the present embodiment includes a conductor 11, a first flame-retardant layer 20, an insulating layer 22, and a second flame-retardant layer 24.

According to the present embodiment, the insulating layer 22 is arranged on an outer periphery of the first flame-retardant layer 20, and the second flame-retardant layer 24 is arranged on an outer periphery of the insulating layer 22. In other words, the coating layer is formed by stacking three layers that are the first flame-retardant layer 20, the insulating layer 22, and the second flame-retardant layer 24 in this order from the conductor 11 side.

(Conductor)

As the conductor 11, not only a normally-used metal wire such as a copper wire or a copper alloy wire but also an aluminum wire, a gold wire, and a silver wire can be used. A metal wire whose outer periphery is metal-plated with tin, nickel or others may be used. Further, a bunch stranded conductor formed by strand metal wires can be also used. A cross-sectional area and an outer diameter of the conductor 11 can be properly changed in accordance with the electrical characteristics required for the insulated wire 1. For example, the cross-sectional area is exemplified to be equal to or larger than 1 $mm^2$ and equal to or smaller than 10 $mm^2$, and the outer diameter is exemplified to be equal to or larger than 1.20 mm and equal to or smaller than 2.30 mm.

(First Flame-Retardant Layer)

It is preferred that the first flame-retardant layer 20 is formed by, for example, extruding a flame-retardant resin composition to the outer periphery of the conductor 11 so that the oxygen index is larger than 45. In the present embodiment, the first flame-retardant layer 20 is formed so that the oxygen index is larger than 45, and thus, contributes to the flame-retardant property of the coating layer. In addition, since the first flame-retardant layer 20 is covered with the insulating layer 22, the water infiltration into the first flame-retardant layer 20 is suppressed when the insulated wire 1 is immersed into water to evaluate its direct-current stability, and therefore, the first flame-retardant layer 20 has the high insulation reliability, and also contributes to the direct-current stability of the coating layer. That is, the first flame-retardant layer 20 contributes to not only the flame-retardant property but also to the direct-current stability, and functions as a flame-retardant insulating layer.

The first flame-retardant layer 20 is not limited in the oxygen index, but preferably has the oxygen index larger than 45 from the viewpoint of the flame-retardant property. Note that the oxygen index is an index of the flame-retardant property, and is defined by the standard JIS K7201-2 in the present embodiment.

The flame-retardant resin composition making up the first flame-retardant layer 20 contains a resin component and a flame retardant when necessary. It is preferable that such a flame-retardant resin composition be a non-halogen flame-retardant resin composition.

A type of the resin component making up the first flame-retardant layer 20 may be properly chanced in accordance with characteristics required for the insulated wire 1, such as elongation and strength. For example, polyolefin, polyimide, polyether ether ketone (PEEK), etc., can be used. When a polymer with a high flame-retardant property is used, addition of the flame retardant is optional. When the polyolefin is used, it is preferable to mix a large amount of the flame retardant in order to increase the oxygen index of the first flame-retardant layer 20. When the polyimide or the PEEK is used, each material has a high flame-retardant property of the resin itself, and therefore, it is not required to mix the flame retardant. In comparison with the polyimide, etc., the polyolefin has a lower forming temperature, and therefore, has better formability of the first flame-retardant layer 20, and besides, has larger breaking elongation to cause better bendability of the first flame-retardant layer 20.

As the polyolefin, a polyethylene-based resin, polypropylene-based resin, etc., can be used, and the polyethylene-based resin is particularly preferable. As the polyethylene-based resin, for example, linear low-density polyethylene (LLDPE), low-density polyethylene (LDPE), high-density polyethylene (HDPE), ethylene-(α-olefin) copolymer, ethylene-vinyl acetate copolymer (EVA), ethylene-acrylic acid ester copolymer, ethylene-propylene-diene copolymer, etc., can be used. Out of these resins, one type may be singularly used, or two or more types may be used in combination. From the viewpoint of obtaining the higher flame-retardant property of the first flame-retardant layer 20, EVA of these polyolefin-based resins is particularly preferable.

As the flame retardant, a non-halogen flame retardant is preferable because it does not generate a toxic gas, and, for example, a metallic hydroxide can be used. The metallic hydroxide decomposes and dehydrates when the first flame-retardant layer 20 is heated to burn, and reduces a temperature of the first flame-retardant layer 20 because of released moisture, and suppresses the burning. As the metallic hydroxide, for example, magnesium hydroxide, aluminum hydroxide, calcium hydroxide, and metallic hydroxide obtained by dissolving nickel in solution of such a material can be used. Out of these flame retardant materials, one type may be singularly used, or two or more types may be used in combination.

From the viewpoint of controlling the mechanical characteristics (balance between the tensile strength and the breaking elongation) of the first flame-retardant layer 20, a surface of the flame retardant is preferably treated with a silane coupling agent, titanate-based coupling agent, fatty acid such as stearic acid, fatty acid salt such as stearate salt, or fatty acid metal salt such as calcium stearate.

From the viewpoint of setting the oxygen index of the first flame-retardant layer 20 to be larger than 45, a mixture amount of the flame retardant is preferable to be equal to or larger than 150 parts by mass and equal to or smaller than 250 parts by mass per 100 parts by mass of a resin. When the mixture amount is smaller than 150 parts by mass, there is a risk of failing to obtain the desired high flame-retardant property in the insulated wire 1. When the mixture amount is larger than 250 parts by mass, there is a risk of reduction in the mechanical characteristics of the first flame-retardant layer 20, which results in the reduction in the elongation.

When necessary, additives such as other flame retardant, flame retardant promoter, filler, cross-linking agent, cross-linking promoter, plasticizer, metal chelator, softener, reinforcing agent, surfactant, stabilizer, ultraviolet absorber, light stabilizer, lubricant, antioxidant, colorant, processing modifier, inorganic filler, compatibilizer, foaming agent, and antistatic agent may be added to the resin component making up the first flame-retardant layer 20.

A thickness of the first flame-retardant layer 20 is exemplified to be equal to or larger than 0.03 mm and equal to or smaller than 0.3 ram although not particularly limited to a specific value.

Note that the first flame-retardant layer 20 may be cross-linked. For example, it may be cross-linked by radiation such as electron beam. Alternatively, it may be cross-linked after a cross-linking promoter is added to the flame-retardant resin composition making up the first flame-retardant layer 20, and then, the flame-retardant resin composition is extrusion-molded.

(Insulating Layer)

The insulating layer 22 is preferably made of an insulating resin composition whose volume resistivity is larger than $5.0\times10^{15}$ (Ωcm) to be configured so that a water absorption amount and a water diffusion coefficient are small. The insulating layer 22 has a high water impervious property, and hardly allows water to infiltrate therein, and therefore, the water infiltration into the first flame-retardant layer 20 located inside the coating layer can be suppressed. Although the insulating layer 22 practically contains no flame retardant and has therefore a low flame-retardant property, the insulating layer 22 is covered with the second flame-retardant layer 24 described later.

A material making up the insulating layer 22 is preferably a material whose volume resistivity is larger than $5.0\times10^{15}$ (Ωcm), and there is no particular upper limit in the volume resistivity. When the volume resistivity is larger than $5.0\times10^{15}$ (Ωcm), the insulation resistance is improved at the time of water absorption in the insulting layer 22, and therefore, this is preferable in the direct-current stability. In this specification, note that the volume resistivity is evaluated in conformity to the JIS C2151.

From the viewpoint of ensuring the forming workability of the insulating layer 22, a resin is preferable as a material making up the insulating layer 22, and the same resin as that of the first flame-retardant layer 20 can be used. Polyolefin is more preferable for the insulating layer 22, and high-density polyethylene and/or low-density polyethylene can be used. Among these materials, linear low-density polyethylene (LLDPE) is particularly preferable because of a low moisture absorption rate, favorable formability, relatively large breaking elongation, other excellent properties such as high oil resistance (solvent resistance), and inexpensiveness.

When the insulating layer 22 is made of such a resin as LLDPE, for example, an insulating resin composition containing LLDPE is formed by its extrusion molding to the outer periphery of the first flame-retardant layer 20. From the viewpoint of further improving the water impervious property of the insulating layer 22, it is preferable to form the insulating layer 22 from a cross-linked substance by mixture and cross-linking of a cross-linking agent, a cross-linking promoter, etc., to/with the insulating resin composition. Because of the cross-linking, a molecular structure of the resin becomes rigid, so that the water impervious property of the insulating layer 22 can be improved. Besides, the strength of the insulating layer 22 can be also improved. Therefore, even if the insulating layer 22 is thinned, the high water impervious property can be kept without losing the strength. The insulating layer 22 is preferably a non-halogen resin composition.

It is preferable to form the cross-linked substance making up the insulating layer 22 so that its gel fraction is equal to or larger than 40% and equal to or smaller than 100%. The strength and the water impervious property of the insulating layer 22 can be increased by increase in the gel fraction of the cross-linked substance, and therefore, the insulating layer 22 can be thinned.

For the case of the cross-linking of the insulating layer 22, it is better to mix a known cross-linking agent or cross-linking promoter to the insulating resin composition. As the cross-linking agent, for example, organic peroxide, a silane coupling agent, etc., can be used. As the cross-linking promoter, for example, a polyfunctional monomer such as triallyl isocyanurate and trimethylol propane triacrylate can be used. Such a material is not limited in a mixture amount. For example, the mixture amount may be changed properly so that a degree of the cross-linking of the cross-linked substance making up the insulating layer 22 in terms of the gel fraction is equal to or larger than 40% and equal to or smaller than 100%. As a cross-linking method, a publicly-known method such as chemical cross-linking and electron beam cross-linking can be adopted in accordance with a type of the cross-linking agent.

The insulating layer 22 can contain an additive equal to or smaller than 5 parts by mass per 100 parts by mass of the resin component. The insulating layer 22 contains preferably the additive equal to or smaller than 3 parts by mass, and more preferably the additive equal to or smaller than 1.5 parts by mass.

Here, the additive means an additive such as cross-linking agent, cross-linking promoter, copper inhibitor, flame retardant, flame retardant promoter, plasticizer, filler, metal chelator, softener, reinforcing agent, surfactant, stabilizer, ultraviolet absorber, light stabilizer, lubricant, antioxidant, colorant (e.g., carbon black), processing modifier, inorganic filler, compatibilizer, foaming agent, and antistatic agent.

(Second Flame-Retardant Layer)

The second flame-retardant layer 24 is preferably formed by, for example, extrusion of a flame-retardant resin composition containing a flame retardant to the outer periphery of the insulating layer 22 so that the oxygen index is larger than 45 as similar to the first flame-retardant layer 20. The second flame-retardant layer 24 is positioned on the surface layer of the coating layer and is not covered with the insulating layer 22 as different from the first flame-retardant layer 20, and therefore, the second flame-retardant layer 24 allows the water to easily infiltrate therein and does not contribute to the direct-current stability. However, the second flame-retardant layer 24 covers the insulating layer 22 having the low flame-retardant property to suppress the reduction in the flame-retardant property of the entire coating layer. It is preferable to form the second flame-retardant layer 24 from a non-halogen flame-retardant resin composition.

Note that the same flame-retardant resin composition as that making up the first flame-retardant layer 20 can be used as the flame-retardant resin composition making up the second flame-retardant layer 24. The second flame-retardant layer 24 may be cross-linked as similar to the first flame-retardant layer 20. The second flame-retardant layer 24 may be cross-linked by, for example, performing a cross-linking treatment after mixture of a cross-linking agent or a cross-linking promoter with the resin composition making up the second flame-retardant layer 24, and extrusion. A cross-linking method is not limited to any particular method. A related-art publicly-known cross-linking method such as irradiation with electron beam may be adopted.

(Stacked Structure of Coating Layer)

Subsequently, a stacked structure of the coating layer (the first flame-retardant layer, the insulating layer, and the second flame-retardant layer) will be described. In the coating layer, the thickness of the insulating layer 22 is not particularly limited, but is preferably equal to or larger than 0.05 mm from the viewpoint of the water impervious property. When this is equal to or larger than 0.05 mm, a strength of the insulating layer 22 can be enhanced, and therefore, the insulating layer 22 can be suppressed from being broken at the time of bending of the insulated wire 1. In this manner, the water impervious property of the insulating layer 22 can be further improved, and the first flame-retardant layer 20 can further contribute to the direct-current stability. Meanwhile, an upper limit of the thickness of the insulating layer 22 is not particularly limited. However, from the viewpoint of the flame-retardant property of the insulated wire 1, the thickness is preferably equal to or smaller than 0.10 mm. Since the insulating layer 22 does not practically contain the flame retardant, there is a risk of decrease in the flame-retardant property of the insulated wire 1. However, when the insulating layer 22 is formed so that the thickness is equal to or smaller than 0.10 mm, the flame-retardant property of the insulated wire 1 can be further improved, and the flame-retardant property can be kept high.

In the coating layer, each thickness of the first flame-retardant layer 20 and the second flame-retardant layer 24 is not particularly limited, and may be properly changed in accordance with the flame-retardant property and the direct-current stability required for the coating layer. From the viewpoint of obtaining the higher flame-retardant property, it is preferable to form the first flame-retardant layer 20 and the second flame-retardant layer 24 so that a total thickness of these layers is equal to or larger than 0.35 mm.

The first flame-retardant layer 20 contributes to the flame-retardant property and the direct-current stability of the coating layer. Therefore, from the viewpoint of obtaining the desired direct-current stability, the thickness of the flame-retardant semiconductive layer 20 is preferably at least 0.5 or more times a wire diameter of the metal wire making up the conductor 11. For example, if a conductor diameter is equal to or smaller than 0.20 mm, the thickness is preferably equal to or larger than 0.1 mm. An excessively thin first flame-retardant layer 20 cannot sufficiently cancel the surface irregularity of the conductor 11 caused by the metal wire when the conductor 11 is made by stranding a plurality of metal wires together, and therefore, there is a risk of the formation of the irregularly-surfaced insulating layer 22 on the first flame-retardant 20. Accordingly, the thickness of the first flame-retardant layer 20 is set to be within the above-described thickness range, so that the first flame-retardant layer 20 can be flattened to reduce the surface irregularity of the insulating layer 22. Meanwhile, its upper limit is not particularly limited, and can be properly changed in consideration of the flame-retardant property of the coating layer and the diameter reduction in the insulated wire 1.

Since the second flame-retardant layer 24 covers the insulating layer 22 to suppress its burning, the thickness of the flame-retardant layer 24 is preferably at least equal to or larger than 0.25 mm. Meanwhile, its upper limit is not particularly limited, and can be properly changed in consideration of the flame-retardant property of the coating layer and the diameter reduction in the insulated wire 1.

The coating layer shown in FIG. 1 according to the embodiment of the present invention is formed of three layers. Meanwhile, the three layers may have a multi-layered structure in which a plurality of the first flame-retardant layers 20 may be formed on an outer periphery of the conductor 11, a plurality of the insulating layers 22 may be formed on an outer periphery of the first flame-retardant layer 20, and a plurality of the second flame-retardant layers 24 may be formed on an outer periphery of the insulating layer 22.

It is only required to form the first flame-retardant layer on the outer periphery of the conductor 11, the second flame-retardant layer 24 as the outermost layer, and the insulating layer 22 between these two layers. There is no problem of existence of a different resin composition layer between the first flame-retardant layer 20 and the insulating layer 22 and between the insulating layer 22 and the second flame-retardant layer 24.

Figure 2:
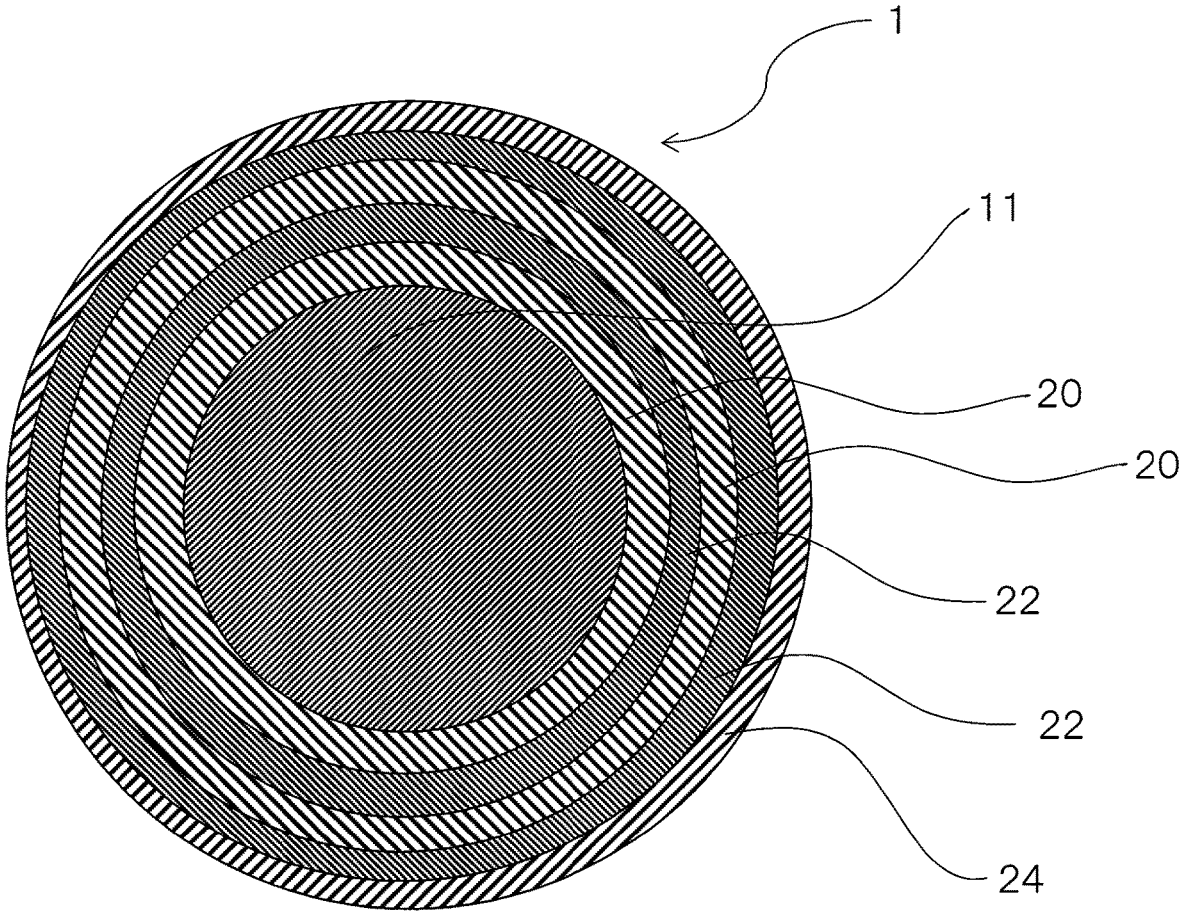
FIG. 2 is a horizontal cross-sectional view showing another embodiment of an insulated wire of the present invention.

As shown in FIG. 2, a plurality of the first flame-retardant layers 20 and a plurality of the insulating layers 22 may be provided so as to form a five-layer structure in which the insulating layers 22 are interposed among three flame-retardant layers (the first flame-retardant layer 20, the first flame-retardant layer 20, and the second flame-retardant layer 24).

If there is a different insulating layer other than the first flame-retardant layer 20, the insulating layer 22 and the second flame-retardant layer 24, "the thickness of the coating layer" described here means a total thickness of the entire insulating layers including the different insulating layer.

Note that the insulated wire of the present embodiment is not particularly limited in its application. However, the insulated wire can be used as, for example, a power system wire (an insulated wire in conformity to Power & Control Cables described in EN 50264-3-1 (2008)).

PRACTICAL EXAMPLES

Next, the present invention will be further described in detail on the basis of practical examples. However, the present invention is not limited by these practical examples.

<Materials Used in Practical Examples and Comparative Examples>

Ethylene-vinyl acetate (EVA) copolymer: "EvaFlex EV170" produced by Du Pont-Mitsui Polychemicals Co., Ltd.

Maleic acid modified polymer: "TAFMAR MH7020" produced by Mitsui Chemicals, Inc.

Thermoplastic polyimide: "AURUM PL450C" produced by Mitsui Chemicals, Inc.

Silicone modified polyetherimide: "STM1500" produced by SABIC Corporation

Linear low-density polyethylene (LLDPE): "EVOLUE SP2030" produced by Prime Polymer Co., Ltd.

Flame retardant (magnesium hydroxide): "KISUMA 5A" produced by Kyowa Chemical Industry Co., Ltd.

Mixed-system antioxidant: "Adekastab AO-18" produced by ADEKA Corporation

Phenolic-system antioxidant: "Irganox1010" produced by BASF SE Corporation

Carbon black: "ASAHI THERMAL" produced by Asahi Carbon Co., Ltd.

Lubricant (zinc stearate)

Cross-linking promoter (trimethylol propane triacrylate (TMPT)): produced by Shin Nakamura Chemical Co., Ltd.

<Preparation of Flame-Retardant Semiconductive Resin Composition>

75 parts by mass of the EVA, 25 parts by mass of the maleic acid modified polymer, 150 parts by mass of the magnesium hydroxide, 2 parts by mass of the cross-linking promoter, 2 parts by mass of the mixed-system antioxidant, 2 parts by mass of the carbon black, and 1 part by mass of the lubricant were mixed together, and the mixture was kneaded by using a 75-L pressure kneader. After the kneading, the kneaded mixture was extruded by using an extruder to form a strand, and was cooled in water and cut, so that a pellet flame-retardant resin composition was obtained. This pellet had a cylindrical shape having a diameter of about 3 mm and a height of about 5 mm. Note that the oxygen index was 41.5.

<Preparation of Insulating Resin Composition>

To prepare the insulating resin composition for making up the insulating layer 22, 100 parts by mass of the LLDPE and 1 part by mass of the phenolic-system antioxidant were dry-blended and kneaded together by using a pressure kneader, so that the insulating resin composition was prepared.

Production of Insulated Wire

First Practical Example

The insulated wire 1 was produced by using the above-described flame-retardant resin composition and insulating resin composition. Specifically, the insulated wire 1 of a first practical example was produced by three-layer co-extrusion of the flame-retardant resin composition, the insulating resin composition, and the flame-retardant resin composition each of which has a predetermined thickness onto an outer periphery of a tin-plated copper conductor wire having an outer diameter of 1.25 mm, and then, by cross-linking of each component with such irradiation with electron beam as causing an absorbed dose of 75 kGy. In the produced insulated wire 1, the first flame-retardant layer having the thickness of 0.10 mm, the insulating layer having the thickness of 0.10 mm, and the second flame-retardant layer having the thickness of 0.30 mm were formed in this order from the conductor side, and an outer diameter of the insulated wire was 2.25 mm. The thickness of the coating layer was 0.50 mm.

The produced insulated wire 1 was evaluated in the mechanical strength, the direct-current stability, the flame-retardant property and the diameter reduction under the following method.

<Characteristic Evaluation>

(Mechanical Strength)

For the mechanical strength, the breaking elongation under the tensile test was evaluated on the basis of EN50264, 60811-1-2. Specifically, the tensile test with a tension rate of 200 m/min was executed to a cylindrical sample that was obtained by pulling out the conductor from the insulated wire. When the breaking elongation was equal to or larger than 150%, its result was evaluated as "○". When the breaking elongation was smaller than 150%, its result was evaluated as "X".

(Direct-Current Stability)

The direct-current stability was evaluated under the direct-current stability test in conformity to EN50305.6.7. Specifically, after the insulated wire 1 was immersed in a 3% NaCl aqueous solution at 85° C. and applied with a voltage of 1500 V, when the electrical breakdown did not occur even after the elapse of 240 hours or longer, its result was evaluated as "pass (○)" indicating excellent electrical characteristics. When the electrical breakdown occurred within less than the elapse of 240 hours, its result was evaluated as "fail (X)".

(Flame-Retardant Property)

For the flame-retardant property, the vertical tray flame test (VTFT) was executed on the basis of EN50266-2-4. Specific seven electrical wires each having an entire length of 3.5 m were stranded to produce one bunch stranded wire, eleven bunch wires were vertically arranged with equal intervals and were burned for 20 minutes, and then, were self-extinguished. Then, its char length was targeted to be equal to or shorter than 2.5 m from the lower end. When the char length was equal to or shorter than 2.5 m, its result was evaluated as "pass (○)". When the char length was longer than 2.5 m, its result was evaluated as "fail (X)".

As each thickness of the first flame-retardant layer, the insulating layer, and the second flame-retardant layer, an average obtained by separating a sample having a length of 1 m into 10 segments and observing and measuring each cross section of these segments by using a microscope was employed.

The three-layer co-extrusion was executed by using three single-screw extruders and combining the resin compositions in a crosshead.

(Diameter Reduction)

In comparison with data of Conductor diameter and Mean thickness of insulation shown: in "Table 1"—"General data"—"Cable type 0.6/1 kV unsheathed" in EN50264-3-1 (2008), when the thickness of the coating layer was larger than the outer diameter of the conductor, its result was evaluated as "fail (X)". When the thickness of the coating layer was smaller than the outer diameter of the conductor, its result was evaluated as "pass (○)".

Second and Third Practical Examples

In second and third practical examples, respective outer diameters of the tin-plated copper conductor wires were set to 1.46 mm and 1.97 mm, respectively, and the thicknesses of the first flame-retardant layer and the second flame-retardant layer were changed.

Results of the above-described first to third practical examples are shown in a table 1.

TABLE 1

| | | First practical example | Second practical example | Third practical example |
|---|---|---|---|---|
| Conductor | Outer diameter (mm) | 1.25 | 1.46 | 1.97 |
| First flame-retardant layer | Thickness (mm) | 0.10 | 0.11 | 0.11 |
| Insulating layer | Thickness (mm) | 0.10 | 0.12 | 0.12 |
| Second flame-retardent layer | Thickness (mm) | 0.30 | 0.35 | 0.35 |
| Coating layer | Thickness (mm) | 0.50 | 0.58 | 0.58 |
| Insulated wire | Outer diameter (mm) | 2.25 | 2.62 | 3.13 |
| Characteristic evaluation result | Mechanical strength | ○ | ○ | ○ |
| | Direct-current stability | ○ | ○ | ○ |
| | Flame-retardant property | ○ | ○ | ○ |
| | Diameter reduction | ○ | ○ | ○ |

First to Third Practical Examples

The first to third practical examples passed (○) in the mechanical strength, the direct-current stability, the flame-retardant property and the diameter reduction.

First to Third Comparative Examples

In each of first to third comparative examples, an insulated wire with the insulating layer and the second flame-retardant layer having the thicknesses shown in a table 2 in which the outer diameter of the tin-plated copper conductor wire was 1.25 mm was produced without using the first flame-retardant layer.

It was confirmed that the first comparative example passed (○) in the mechanical strength, the direct-current stability, and the flame-retardant property.

However, while the outer diameter of the conductor was 1.25 mm and the thickness of the coating layer was 0.70 mm in the first comparative example, the outer diameter of the conductor was 1.25 mm and the thickness of the coating layer was 0.6 mm in Table 1 of EN50264-3-1 described above. Therefore, in comparison between both thicknesses of the coating layers, the first comparative example failed (X) in the diameter reduction because the thickness of the coating layer was larger than the outer diameter of the conductor.

In a second comparative example, the insulated wire was produced so that the thickness of the coating layer was 0.30 mm. And, the second comparative example failed (X) in the direct-current stability and the mechanical strength but passed (○) in the flame-retardant property.

In a third comparative example, the insulated wire was produced so that the thickness of the coating layer was 0.40 mm. And, the third comparative example failed (X) in the direct-current stability, the mechanical strength and the flame-retardant property.

Fourth and Fifth Comparative Examples

In each of fourth and fifth comparative examples, an insulated wire was produced so that the outer diameter of the tin-plated copper conductor wire was 1.46 mm.

It was confirmed that the fourth comparative example passed (○) in the mechanical strength, the direct-current stability, and the flame-retardant property.

However, while the outer diameter of the conductor was 1.46 mm and the thickness of the coating layer was 0.80 mm in the fourth comparative example, the outer diameter of the conductor was 1.5 mm and the thickness of the coating layer was 0.7 mm in Table 1 of EN50264-3-1 described above. Therefore, in comparison between thicknesses of the coating layers of the fourth comparative example and Table 1 of EN502.64-3-1, the fourth comparative example failed (X) in the diameter reduction because the thickness of the coating layer was larger than the outer diameter of the conductor.

In a fifth comparative example, although the thickness of the coating layer was 0.58 mm, the fifth comparative example passed (○) in the mechanical strength but failed (X) in the direct-current stability, and passed in the flame-retardant property.

Sixth and Seventh Comparative Examples

In each of sixth and seventh comparative examples, an insulated wire was produced so that the outer diameter of the tin-plated copper conductor wire was 1.97 mm.

It was confirmed that the sixth comparative example passed (○) in the mechanical strength, the direct-current stability, and the flame-retardant property.

However, while the outer diameter of the conductor was 1.97 mm and the thickness of the coating layer was 0.80 mm in the sixth comparative example, the outer diameter of the conductor was 1.95 mm and the thickness of the coating layer was 0.7 mm in Table 1 of EN50264-3-1 described above. Therefore, in comparison between thicknesses of the coating layers of the sixth comparative example and Table 1 of EN50264-3-1, the sixth comparative example failed (X) in the diameter reduction because the thickness of the coating layer was larger than the outer diameter of the conductor.

In a seventh comparative example, the insulated Wire was produced so that the thickness of the coating layer was 0.58 mm. And, the seventh comparative example failed (X) in the direct-current stability but passed (○) in the mechanical strength and the flame-retardant property.

Results of the above-described first to seventh comparative examples are shown in a following table 2.

TABLE 2

| | | First comparative example | Second comparative example | Third comparative example | Fourth comparative example |
|---|---|---|---|---|---|
| Conductor | Outer diameter (mm) | 1.25 | 1.25 | 1.25 | 1.46 |
| First flame-retardant layer | Thickness (mm) | 0 | 0 | 0 | 0 |
| Insulating layer | Thickness (mm) | 0.3 | 0 | 0.11 | 0.35 |
| Second flame-retardant layer | Thickness (mm) | 0.4 | 0.3 | 0.29 | 0.45 |
| Coating layer | Thickness (mm) | 0.7 | 0.3 | 0.4 | 0.8 |
| Insulated wire | Outer diameter (mm) | 2.65 | 1.85 | 2.05 | 3.06 |
| Characteristic evaluation result | Mechanical strength | ○ | X | X | ○ |
| | Direct-current stability | ○ | X | X | ○ |
| | Flame-retardant property | ○ | ○ | X | ○ |
| | Diameter reduction | X | ○ | ○ | X |

| | | Fifth comparative example | Sixth comparative example | Seventh comparative example |
|---|---|---|---|---|
| Conductor | Outer diameter (mm) | 1.46 | 1.97 | 1.97 |
| First flame-retardant layer | Thickness (mm) | 0 | 0 | 0 |
| Insulating layer | Thickness (mm) | 0 | 0.35 | 0 |
| Second flame-retardant layer | Thickness (mm) | 0.58 | 0.45 | 0.58 |
| Coating layer | Thickness (mm) | 0.58 | 0.8 | 0.58 |
| Insulated wire | Outer diameter (mm) | 2.62 | 3.57 | 3.13 |
| Characteristic evaluation result | Mechanical strength | ○ | ○ | ○ |
| | Direct-current stability | X | ○ | X |
| | Flame-retardant property | ○ | ○ | ○ |
| | Diameter reduction | ○ | X | ○ |

What is claimed is:

1. An insulated wire comprising:

a conductor; and a coating layer arranged on an outer periphery of the conductor, wherein the coating layer includes:

a first flame-retardant layer containing a first flame retardant and a first resin component;

an insulating layer arranged on the outer periphery of the first flame-retardant layer, and a second flame-retardant layer arranged on the outer periphery of the insulating layer and containing a second flame retardant and a second resin component, wherein a diameter of the conductor is equal to or smaller than 1.25 mm, and a thickness of the coating layer is smaller than 0.6 mm, wherein a volume resistivity of the insulating layer is larger than $5.0\times10^{15}$ Ωcm, wherein the first flame-retardant layer contains the first flame retardant in an amount of 150 parts by mass or more and 250 parts by mass or less per 100 parts by mass of the first resin component, wherein the second flame-retardant layer contains the second flame retardant in an amount of 150 parts by mass or more and 250 parts by mass or less per 100 parts by mass of the second resin component.

2. The insulated wire according to claim 1, wherein breaking elongation of the coating layer measured in a tensile test with a tension rate of 200 m/min is equal to or larger than 150%.

3. The insulated wire according to claim 1,
wherein the first flame-retardant layer has an oxygen index that is larger than 45,
wherein the second flame-retardant layer has an oxygen index that is larger than 45.

4. The insulated wire according to claim 1,
wherein a flame-retardant resin composition making up layer each of the first resin component and the second resin component includes at least one resin selected from a group consisting of high-density polyethylene, linear low-density polyethylene, low-density polyethylene, ethylene-(α-olefin) copolymer, ethylene-vinyl acetate copolymer, ethylene-acrylic acid ester copolymer, and ethylene-propylene-diene copolymer.

5. The insulated wire according to claim 1,
wherein the insulating layer is made of a cross-linked substance formed by cross-linking of a resin composition.

6. The insulated wire according to claim 1,
wherein a resin composition making up the insulating layer contains a resin component made of high-density polyethylene and/or low-density polyethylene.

7. The insulated wire according to claim 1,
wherein the first flame-retardant layer and the second flame-retardant layer are made of polyolefin, and
wherein the insulating layer is made of polyolefin.

8. The insulated wire according to claim 1,
wherein the first flame-retardant layer has a thickness of greater than or equal to 0.03 mm and less than or equal to 0.3 mm.

9. The insulated wire according to claim 8,
wherein the second flame-retardant layer has a thickness of greater than or equal to 0.25 mm.

10. The insulated wire according to claim 1,
wherein the insulating layer has a thickness of greater than or equal to 0.05 mm.

11. An insulated wire comprising:
a conductor; and
a coating layer arranged on an outer periphery of the conductor,
wherein the coating layer includes:
a first flame-retardant layer containing a first flame retardant and a first resin component;
an insulating layer arranged on the outer periphery of the first fame-retardant layer, and
a second flame-retardant layer arranged on the outer periphery of the insulating layer and containing a second flame retardant and a second resin component,
wherein a diameter of the conductor is larger than 1.25 mm and equal to or smaller than 5.0 mm, and a thickness of the coating layer is smaller than 0.7 mm,
wherein a volume resistivity of the insulating layer is larger than $5.0\times10^{15}$ Ωcm,
wherein the first flame-retardant layer contains the first flame retardant in an amount of 150 parts by mass or more and 250 parts by mass or less per 100 parts by mass of the first resin component,
wherein the second flame-retardant layer contains the second flame retardant in an amount of 150 parts by mass or more and 250 parts by mass or less per 100 parts by mass of the second resin component.

12. The insulated wire according to claim 11,
wherein the first flame-retardant layer and the second flame-retardant layer are made of polyolefin, and
wherein the insulating layer is made of polyolefin.

13. The insulated wire according to claim 11,
wherein the first flame-retardant layer has a thickness of greater than or equal to 0.03 mm and less than or equal to 0.3 mm.

14. The insulated wire according to claim 13,
wherein the second flame-retardant layer has a thickness of greater than or equal to 0.25 mm.

15. The insulated wire according to claim 11,
wherein the insulating layer has a thickness of greater than or equal to 0.05 mm.

16. The insulated wire according to claim 11,
wherein the first flame-retardant layer has an oxygen index that is larger than 45; and
wherein the second flame-retardant layer has an oxygen index that is larger than 45.

* * * * *